US005487997A

United States Patent [19]

Stolp

[11] Patent Number: 5,487,997

[45] Date of Patent: Jan. 30, 1996

[54] PIPETTE TIP MOUNTING AND TRANSFER APPARATUS AND METHOD

[75] Inventor: Philip E. Stolp, Kenwood, Calif.

[73] Assignee: Point Plastics Incorporated, Petaluma, Calif.

[21] Appl. No.: 196,967

[22] Filed: Feb. 15, 1994

[51] Int. Cl.[6] ..... B01L 3/02

[52] U.S. Cl. ..... 436/54; 422/100; 422/104; 206/443; 206/446; 206/562; 206/563; 436/183

[58] Field of Search ..... 436/54, 183; 422/99, 422/100, 104, 103; 206/443, 446, 562, 563

[56] References Cited

U.S. PATENT DOCUMENTS

| | | | |
|---|---|---|---|
| 3,375,934 | 4/1968 | Bates . | |
| 3,494,201 | 2/1970 | Roach . | |
| 3,643,812 | 2/1972 | Mander et al. . | |
| 3,940,249 | 2/1976 | McClurg | 23/230 R |
| 4,124,122 | 11/1978 | Emmitt | 211/74 |
| 4,130,978 | 12/1978 | Cohen . | |
| 4,286,637 | 9/1981 | Wilson . | |
| 4,349,109 | 9/1982 | Scordata et al. . | |
| 4,510,119 | 4/1985 | Hevey . | |
| 4,517,851 | 5/1985 | Tice | 73/864.91 |
| 4,565,100 | 1/1986 | Malinoff . | |
| 4,577,760 | 3/1986 | Rainin et al. . | |
| 4,895,650 | 1/1990 | Wang | 210/222 |
| 4,936,152 | 6/1990 | Aldred . | |
| 5,036,989 | 8/1991 | Carilli . | |
| 5,057,282 | 10/1991 | Linder . | |
| 5,080,232 | 1/1992 | Leoncavallo et al. . | |
| 5,128,105 | 7/1992 | Berthold et al. . | |
| 5,133,939 | 7/1992 | Mahe | 422/104 |
| 5,232,669 | 8/1993 | Pardinas . | |
| 5,324,486 | 6/1994 | Scaramella et al. | 422/100 |

FOREIGN PATENT DOCUMENTS

| | | |
|---|---|---|
| 0174706 | 3/1986 | European Pat. Off. . |
| 3924103 | 1/1991 | Germany . |
| WO9308913 | 5/1993 | WIPO . |

OTHER PUBLICATIONS

"Saving the Environment . . . is at the Tip of Your Fingers!", CLP Continental Laboratory Products, pp. 1–3.

"Earth Day Spring Special," CLP Continental Laboratory Products Incorporated, p. 1.

"Saving the Environment is at the Tip of Your Fingers . . . ," esp–Environmentally Sensitive Packaging, for Pipet Tips, CLP Continental Laboratory Products, p. 1 (enlarged).

"Saving the Environment is at the Tip of Your Fingers . . . ," Take Advantage of the Ultimate in Recycling–Reuse, CLP Continental, pp. 1–2.

Advertisement, "Eppendorf Repeater Pipette," New Eppendorf Envirotips, New Eppendorf Safe–Twist Tubes, New Eppendorf Electronic Pipette; Dealer Bulletin, Brinkmann Instruments, Inc., Mar. 26, 1993, pp. 1–3.

"Green–Pak environmentally–friendly pipette tip–rack refill system," Rainin Instrument Co., Inc., pp. 1–4.

"Green–Pak Spacesaver," Rainin Instrument Company, pp. 1–4.

"Elkay Elite 54 Pack, Environmental Lite Packaging," Elkay Labsystems, pp. 1–2.

"Scientific Specialites New EcoPac," Scientific Specialites Incorporated; The innovation doesn't stop, Intermountain Scientific Corporation, p. 1.

*Primary Examiner*—James C. Housel
*Assistant Examiner*—Long V. Le
*Attorney, Agent, or Firm*—Majestic, Parsons, Siebert & Hsue

[57] ABSTRACT

A pipette tip assembly is provided which includes one or more pipette tips, a tip support and a tip holder which is movable between a tip-holding and a tip-releasing position. Additionally, a pipette tip assembly is provided which includes one or more pipette tips and a tip holder which has tapered apertures therein. Methods of using such assemblies are further provided. The invention provides pipette tip assemblies that facilitate secure transport, minimal handling and convenient and user-controlled operation.

30 Claims, 5 Drawing Sheets

PIPETTE TIP MOUNTING AND TRANSFER APPARATUS AND METHOD

FIELD OF THE INVENTION

The invention relates generally to a pipette tip mounting and transfer apparatus and a method of using same. More specifically, the present invention relates to an assembly comprising one or more pipette tips, a tip support structure and a movable tip holder, in which the tip holder is used to secure the pipette tips during transport, to position the pipette tips relative to the tip support for use and to remove the pipette tips from the tip support.

BACKGROUND OF THE INVENTION

The use of a set of disposable pipette tips and the provision of a carrier therefor are well known. Typically, either a plate carrying a number of pipette tips, usually ninety-six, is provided or a number of such plates, often five, are provided in stacked form as a packaging convenience. In loading the tips for use, a single plate of tips is placed over a support structure (a support rack or another supportive plate of tips) and the tips, variably with or without the single plate, are released into the rack.

In many settings in which pipette tips are used, it is desirable to minimize the user's handling of the tips. However, the prior art tip mounting systems are not fully satisfactory in this regard primarily because in such systems, the tips are disposed somewhat loosely in the carrying plate. Thus, at several points of use, i.e., when the tips and the carrying plate are placed in a package for transport, lifted from such a package after transport using the carrying plate, or placed over a support structure using the carrying plate, the tips are susceptible to becoming displaced from the carrying plate and thus, to requiring manual repositioning in the carrying plate.

The prior art tip mounting and disposal systems are further unsatisfactory in that they consist of unwieldy tip releasing devices. Particularly problematic are prior art systems in which the loosely disposed tips are automatically released when the carrying plate is placed over the support rack. With such systems, the user is undesirably prevented from controlling the carrying plate between a tip-carrying and a tip-releasing position. This lack of user control results in the tips being prematurely displaced from the carrying plate by a simple jolt or contact. More specifically, premature displacement often occurs during placement over the support structure when the tips are not precisely aligned with tip-receiving apertures of the support. Such precise alignment is extremely difficult to achieve with existing loose-tip systems. It is therefore desirable to provide a tip mounting and disposal apparatus that is easy to use and allows the user to control the tip-holding and tip-releasing functions thereof.

SUMMARY OF THE INVENTION

It is an object of the present invention to provide an apparatus for the mounting and transfer of pipette tips in which one or more pipette tips can be rigidly maintained in a pipette tip holder, which is movable between a tip-holding and tip-releasing position and is capable of being positioned relative to a tip support, and a method of using same.

In one aspect of the present invention, a pipette tip assembly is provided which includes one or more pipette tips, a tip support and a tip holder. The pipette tip has an exterior surface which defines a tapered portion which, when the tip is vertically oriented, is inwardly tapered from an upper portion to a lower portion of the tip. Positioned adjacent the upper portion of the tip, but above a lower end of the tip, is an abutment member.

According to this aspect of the present invention, the tip support has at least one support aperture therein for receiving the lower end of the vertically oriented tip. Additionally, the tip support defines a support surface upon which the abutment member of the tip rests when the tip is received in the support aperture.

Furthermore, in this aspect of the present invention, the tip holder is interposed between the abutment member and the upper portion of the tip. The tip holder is constructed to maintain the tip therein and to be movable between an upper position, or tip-holding position, and a lower position, or tip-releasing position. When the tip holder is in the upper position, it serves to rigidly maintain the tip from wobbling in the tip holder. When the tip holder is in the lower position, it allows for the removal of the tip from the tip holder.

According to another aspect of the present invention, a pipette tip assembly is provided which includes one or more pipette tips and a tip holder. The pipette tip has the same structure as that described above. The tip holder differs from the structure described above in that it has at least one holder aperture therein for receiving the tip. The holder aperture has a taper which substantially corresponds to at least a portion of the tapered portion of the tip.

In yet another aspect of the present invention, a method for loading and unloading one or more pipette tips is provided. The method includes the steps of providing one or more pipette tips, a tip support, and a tip holder, as described above in relation to one aspect of the pipette tip assembly. The method further includes placing the tip in the tip holder so that a lower portion of the abutment member extends beyond the tip holder; applying sufficient pressure to the tip to rigidly maintain the tip in the tip holder; positioning the tip holder and the tip maintained therein over the tip support such that the support aperture receives the lower end of the tip; and, moving the tip holder between the upper position and the lower position.

In a further aspect of the present invention, a method for holding one or more pipette tips is provided which includes the steps of providing one or more pipette tips and a tip holder, as described above in relation to another aspect of the pipette tip assembly. The method additionally includes placing the tip in the tip holder so that a lower portion of the abutment member extends beyond the tip holder and applying sufficient pressure to the tip to rigidly maintain the tip in the tip holder.

Particular features of the present invention include the ability to operate the pipette tip assembly between its tip-holding and tip-releasing capacities. According to one aspect of the present invention, the tip holder is used in its tip-holding position to secure the pipette tips during tip transport in a package, tip transfer from the package or other location to the tip support, tip placement relative to the tip support, and tip removal from the tip support for transport, repositioning, disposal or other purposes.

Once the pipette tips have been placed relative to the tip support, the tip holder is moved to its tip-releasing position to release the tips in the tip support such that they can be disengaged from the assembly for use. In a preferred embodiment, a protective cover for the tips may be used to so move the tip holder.

According to a further aspect of the present invention, the tip support consists of one or more supportive tip holders, having tips disposed therein, stacked one atop another. Whether in a single support or a stacked support embodiment, the tips may be returned to the uppermost tip holder of the assembly after use. For tip removal, at least one of the tip holders is lifted away from an underlying tip support and back into its tip-holding position. In this manner, compact removal of multiple tips and one or more tip holders is conveniently achieved with minimal effort and no unnecessary handling of the secured pipette tips themselves. If the removal of the tips is for disposal purposes, such compact removal allows for minimal use of safety materials for the disposal of biological or other environmentally hazardous materials.

Thus, the pipette tip assembly of the present invention eliminates the significant handling problems of existing tip mounting and disposal systems. Particularly, the assembly of the present invention allows the user to control the tip-holding and tip-releasing functions of the assembly, without the use of complicated or unmanageable devices, to remove the removable components of the assembly in a convenient and clean manner and to discard the disposable components of the assembly in a safe and environmentally sound manner.

Additional objects, advantages and features of the various aspects of the present invention will become apparent from the following description of its preferred embodiments, which description should be taken in conjunction with the accompanying drawings.

BRIEF DESCRIPTION OF THE DRAWINGS

FIG. 1A further illustrates, in cut-away, tapered apertures of the tip holder and a raised edge of the tip holder, according to embodiments of the present invention.

FIG. 3A illustrates, in cut-away, the assembly including a plurality of pipette tips disposed in a tip support, a tip holder in a tip-holding position around the pipette tips and a cover adjacent a raised edge of the tip holder.

FIG. 3B schematically illustrates, in partial cut-away, the assembly upon movement of the cover in a direction toward the tip support and consequent movement of the tip holder to a tip-releasing position.

FIG. 3C illustrates the assembly without the cover in which the tip holder is in the tip-releasing position.

FIG. 3D schematically illustrates the assembly upon movement of the tip holder in a direction away from the tip support and consequent movement of the tip holder to a tip-holding position.

DESCRIPTION OF PREFERRED EMBODIMENTS

Figure 1A:
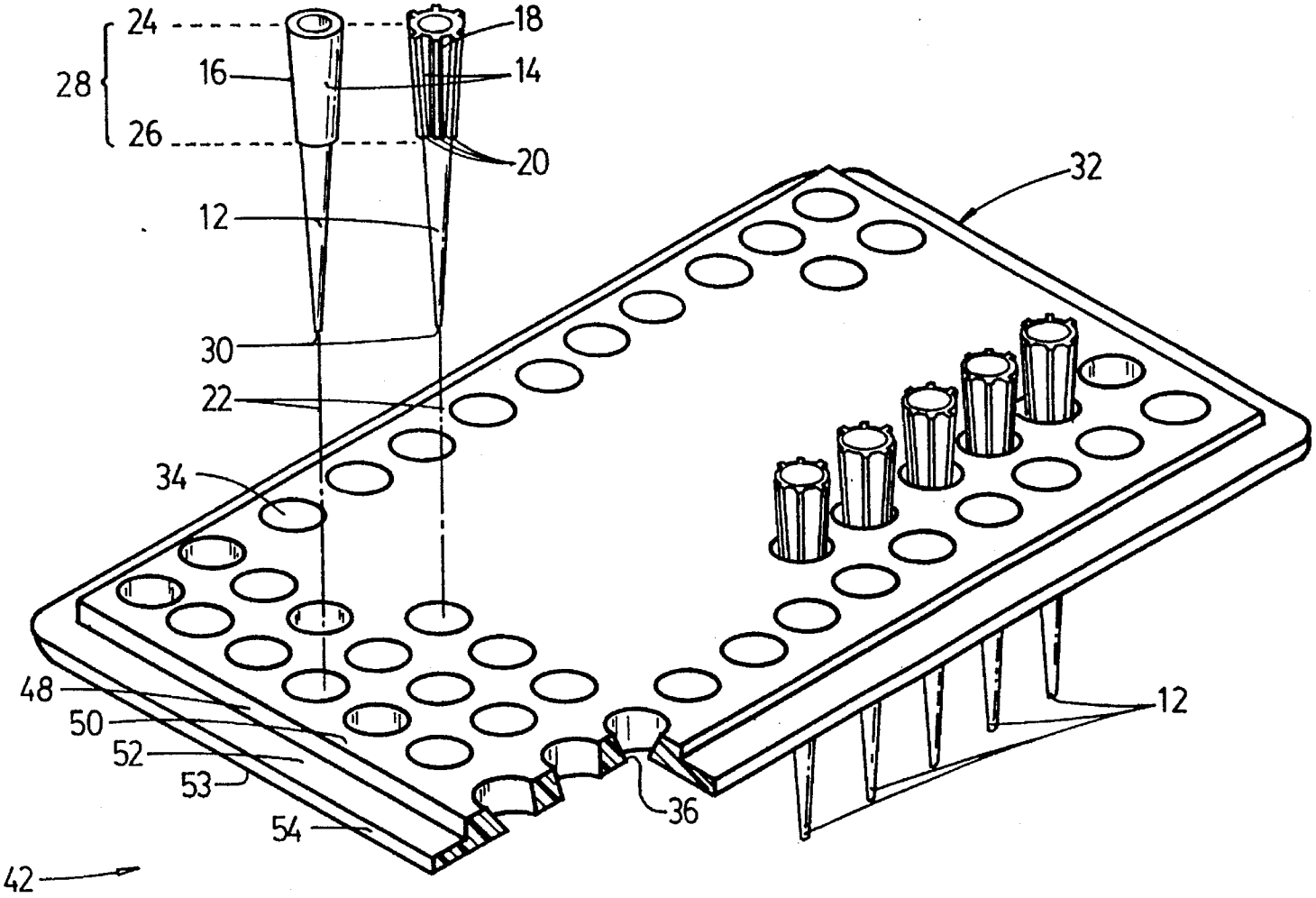
FIG. 1A illustrates an exploded view of a plurality of pipette tips and a tip holder therefor, including: one pipette tip shown above the tip holder, according to an embodiment of the present invention; another pipette tip shown above the tip holder, according to an alternative embodiment of the present invention; and five pipette tips, according to the alternative embodiment, shown disposed within the tip holder.

FIG. 1A illustrates a pipette tip assembly 10 which includes at least one longitudinally extending pipette tip 12. The pipette tip 12 has an exterior surface 14 defining a substantially tapered portion 28. The tapered portion 28 is inwardly tapered from an upper plane 24 towards a lower plane 26, both planes being transverse to a longitudinal axis 22 of the tip 12 when the tip 12 is vertically oriented.

Below the upper plane 24 of the tapered portion 28 and above a lower end 30 of the tip, lies an abutment member 16 or 18. As shown in FIG. 1A, abutment member 16 or 18 may be a substantially smooth-surfaced abutment member 16, or alternatively, a ribbed abutment member 18, having a plurality of ribs 20. In the latter embodiment, ribs 20 are preferably substantially evenly spaced and longitudinally oriented on the exterior surface 14 of the tip 12. While the abutment member 16 or 18 is shown in FIG. 1A as having a substantially smooth surface 16 or a plurality of ribs 20, other shapes are contemplated.

As shown in FIG. 1A, the pipette tip assembly 10 also includes a tip holder 32 which is interposable between the abutment member 16 or 18 and the upper plane 24 of the tapered portion 28 of the tip 12. The tip holder 32 has a construction sufficient to maintain the tip therein. Additionally, tip holder 32 is movable between an upper position 38 and a lower position 40, as shown in FIGS. 2 and 3A–3D. When tip holder 32 is in the upper position 38, tip holder 32 rigidly maintains tip 12 from wobble in tip holder 32. When tip holder 32 is in the lower position 40, tip 12 is removable from tip holder 32 and/or from a tip support 56 described below.

Figure 2:
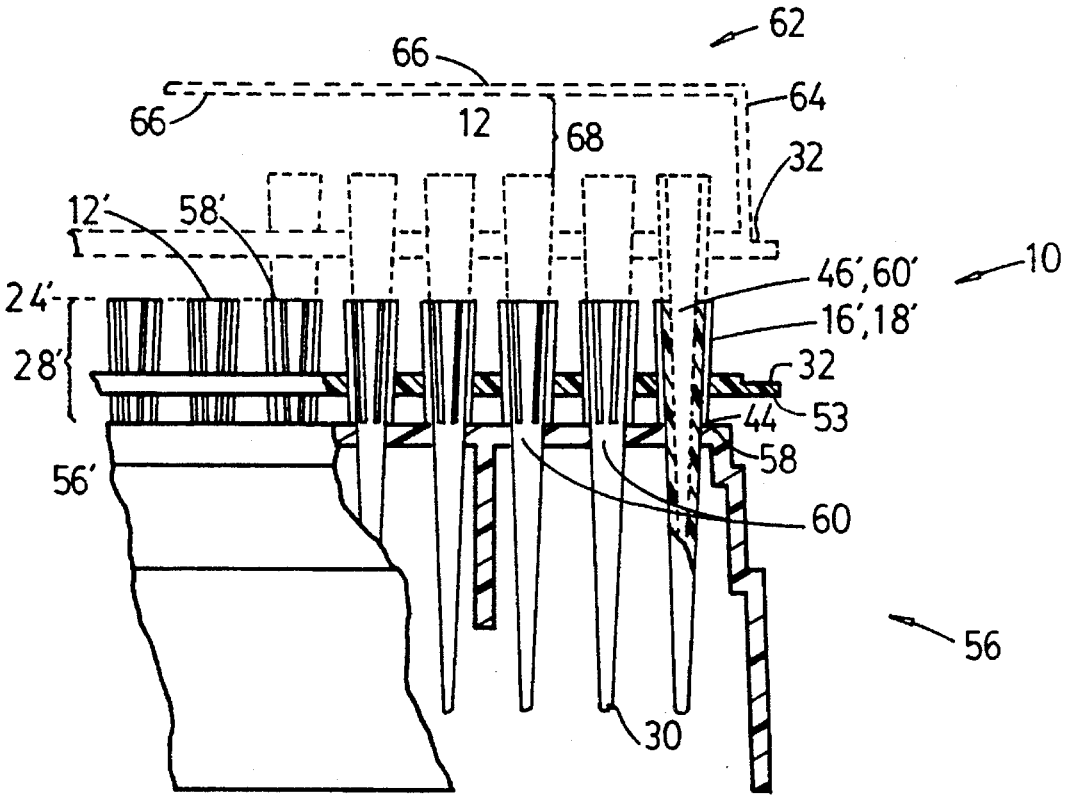
FIG. 2 illustrates an assembly according to embodiments of the present invention, including: a tip support with a solid-lined plurality of pipette tips disposed therein; a solid-lined tip holder in a tip-holding position around the solid-lined pipette tips; a phantom-lined plurality of pipette tips disposed in the solid-lined pipette tips; a phantom-lined tip holder in a tip-holding position around the phantom-lined pipette tips; and a phantom-lined cover adjacent a raised edge of the phantom-lined tip holder.

The pipette tip assembly 10 may include a tip support 56, as shown in FIGS. 2 and 3A–3D. As shown in FIG. 2, tip support 56 defines a support surface 58 and has at least one support aperture 60 therein. The support aperture 60 is adapted to receive the lower end 30 of tip 12 such that abutment member 16 or 18 rests upon support surface 58 when tip 12 is vertically oriented.

Figure 1B:
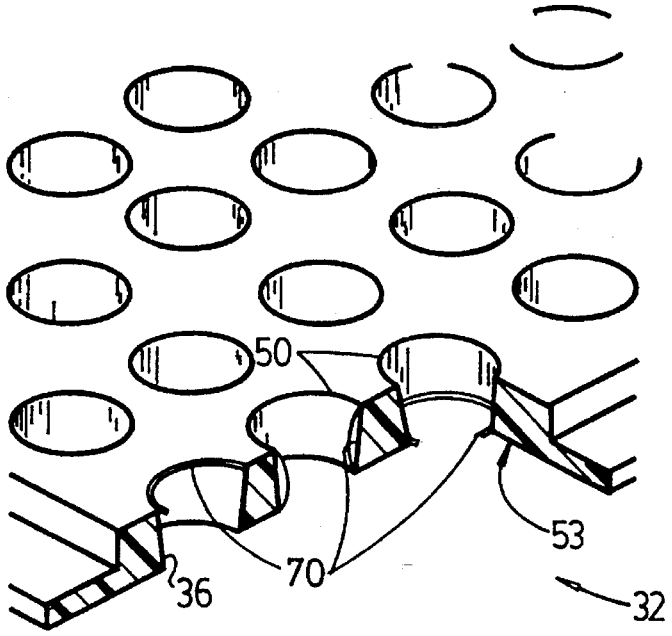
FIG. 1B illustrates, in cut-away, an enlarged view of a tip holder including tip-securing members in the tapered apertures of the tip holder, according to alternative embodiments of the present invention.

Preferably, tip holder 32 of assembly 10 has at least one holder aperture 34 for receiving tip 12. According to a preferred embodiment of the present invention, holder aperture 34 has a taper 36 which substantially corresponds to at least a portion of the taper of tapered portion 28 of tip 12. This taper 36 is shown in FIGS. 1A and 1B.

As illustrated in FIG. 2, holder aperture 34 is of sufficient diameter so that when tip holder 32 is in upper position 38, a lower portion of the abutment member 16 or 18 extends beyond the holder aperture 34, i.e., past an under surface 53 of tip holder 32. According to a preferred embodiment of the present invention, holder aperture 34 rigidly maintains the tip 12 therein when tip holder 32 is in upper position 38, such that tip holder 32 and tip 12 form a substantially unified tip transport structure 42. According to one aspect of the present invention, when tip holder 32 is in upper position 38, it serves as a load member for aligning tip 12 with, and loading tip 12 onto, tip support 56. The resulting loaded assembly 10 is shown in FIGS. 2 and 3A–3C. In another aspect of the present invention, when tip holder 32 is in upper position 38, it acts as a removal member for removing tip 12 from tip support 56, as shown in FIG. 3D. According to yet another aspect of the present invention, shown in FIGS. 3B and 3C, when tip holder 32 is in lower position 40, holder aperture 34 surrounds tip 12 so that tip holder 32 substantially stabilizes tip 12 from transverse movement, with respect to longitudinal axis 22, in tip support 56.

As shown in assembly 10 of FIG. 2, abutment member 16 or 18 has a bearing surface 44 at its lower end. At the bearing surface 44, the outer diameter of the abutment member 16 or 18 is substantially greater than the inner diameter of the support aperture 60 at support surface 58. Preferably, this outer diameter of abutment member 16 or 18 at bearing surface 44 is also substantially less than the inner diameter of the holder aperture 34 at its most tapered portion, i.e., at under surface 53. While shapes other than smooth-surfaced or ribbed shapes are possible for the abutment member, the abutment member preferably has the above-mentioned dimensional characteristics.

According to an alternative embodiment of the present invention, as shown in FIG. 2, pipette tip assembly 10 may comprise a group of stacked pipette tips. In the description of this stacked embodiment, items represented by numerals followed by a prime indication (') refer to the items represented by unprimed numerals throughout this description, but directed to the solid-lined, central portion of the stacked assembly 10 of FIG. 2.

In this embodiment, stacked pipette tip assembly 10 includes at least one other tip support 56' in addition to tip support 56 described above. This other tip support 56' includes at least one other tip 12'. Thus, the support surface 58' of other tip support 56' is actually an upper end of other tip 12' at the upper plane 24' of its tapered portion 28'. Further, the support aperture 60' of other tip support 56' is an opening 46' in the upper end of other tip 12'. Preferably, in this embodiment, the pipette tip assembly 10 further includes at least one other tip holder 32'. Other tip holder 32' has a construction sufficient to maintain other tip 12' therein and is interposable between the abutment member 16' or 18' of other tip 12' and upper plane 24' of tapered portion 28' of other tip 12'. In this manner, other tip support 56' serves to support at least one pipette tip 12 therein. In the stacked embodiment of the present invention, other tip support 56', other tip 12' and other tip holder 32' have all of the attributes of their unprimed counterparts previously and hereinafter described.

According to a preferred embodiment, tip holder 32 has a shape-retaining member 48 for retaining a shape of tip holder 32 when tip holder 32 has tip 12 rigidly maintained therein. As shown in FIG. 1A, shape-retaining member 48 may include a raised edge defining a shape-retaining structure between an upper surface 50 and a lower surface 52 of the tip holder 32. This raised edge may be disposed adjacent a perimeter 54 of tip holder 32, as shown in FIG. 1A. In such an embodiment, the shape-retaining member 48 prevents tip holder 32 from being warped when pipette tips 12 are pressed into the holder apertures 34 of tip holder 32. While shape-retaining member 48 has been described in terms of a raised edge, other configurations are contemplated.

Figure 3A:
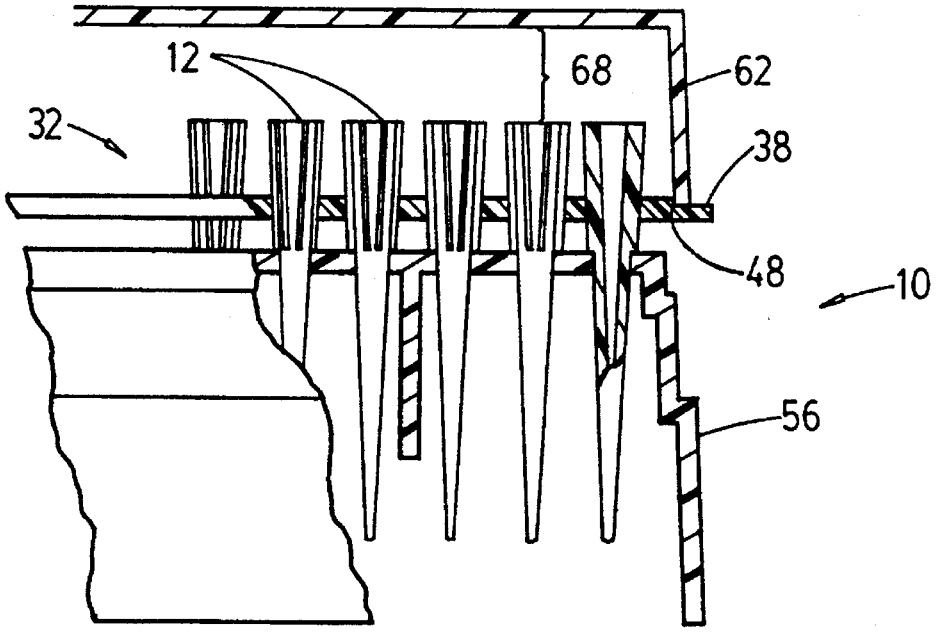
FIGS. 3A–3D illustrate various configurations of an assembly of the present invention.
Figure 3B:
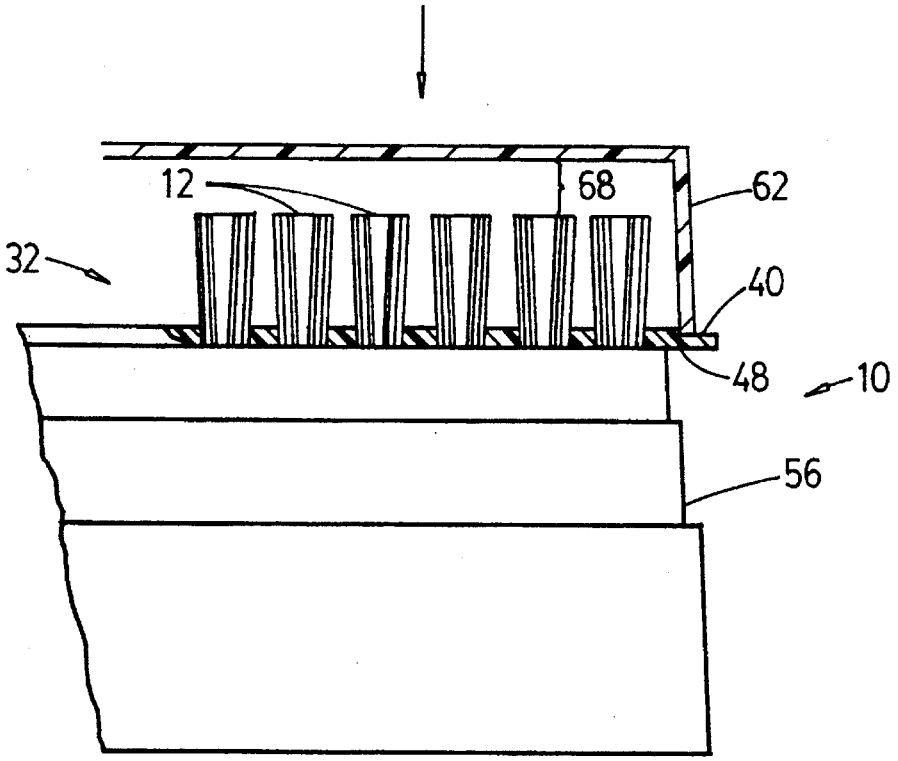
Figure 3C:
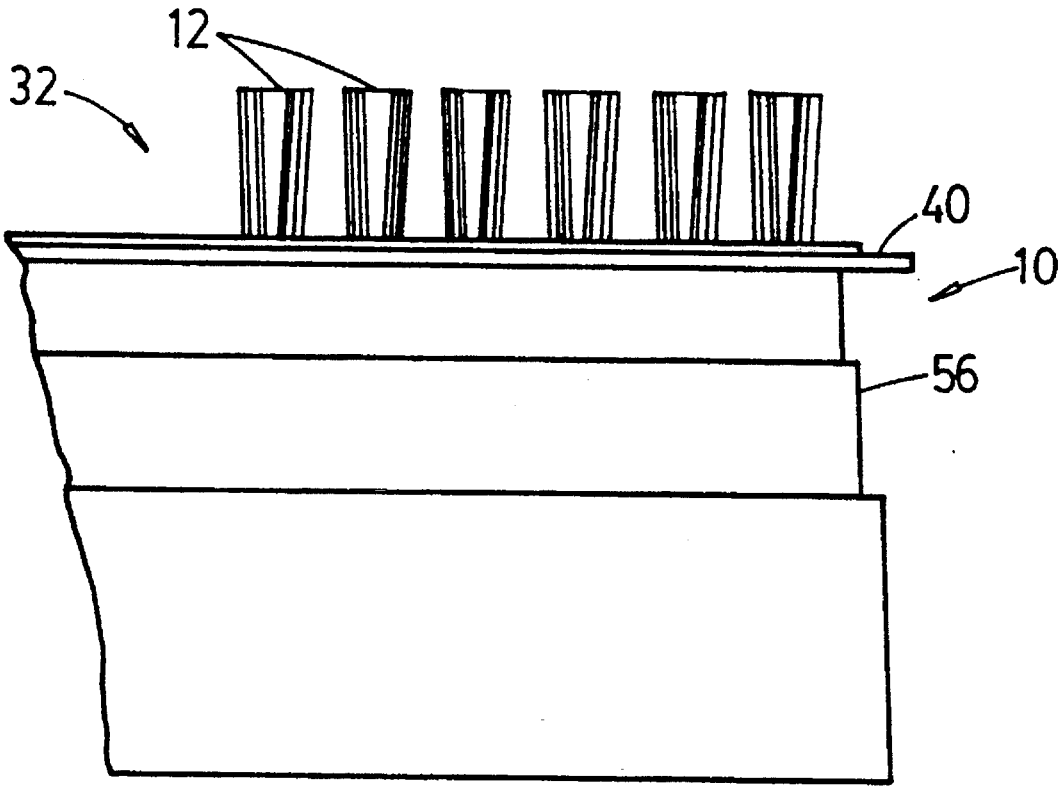
Figure 3D:
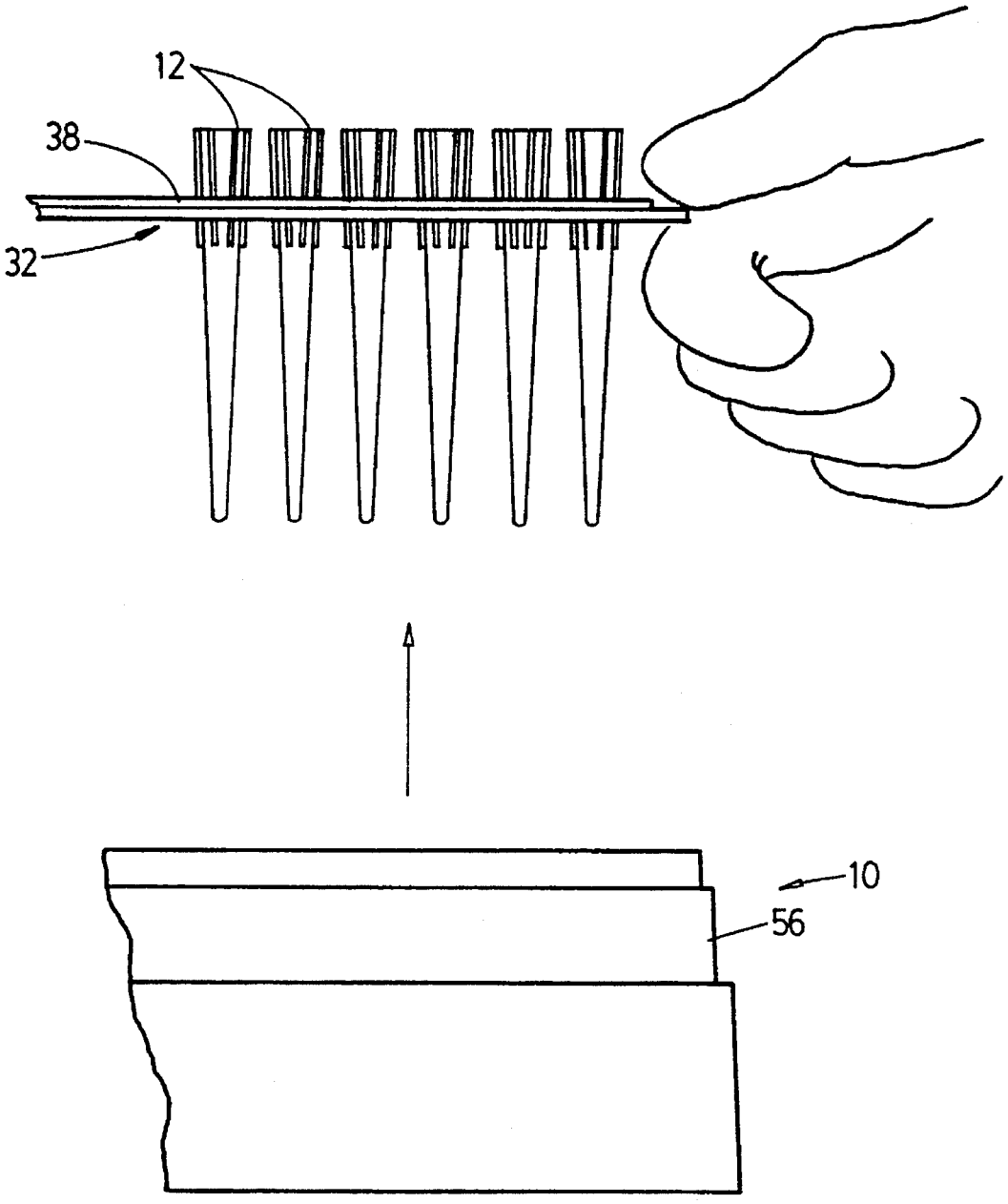

As shown in FIGS. 2, 3A and 3B, the pipette tip assembly 10 may further comprise a cover 62. The cover 62 has a substantially extended portion 64 and a substantially recessed portion 66. Extended portion 64 is formed to conform substantially to a shape of the tip holder 32 adjacent its perimeter 54. Additionally, recessed portion 66 is formed to provide substantially a clearance 68 between tip 12 and cover 62 when cover 62 is positioned over tip holder 32.

As is schematically shown in FIGS. 3A and 3B, cover 62 preferably acts as a positioning member for moving tip holder 32 from upper position 38 to lower position 40. As further shown in FIGS. 3A and 3B, extended portion 64 of cover 62 is formed to conform substantially to the shape of shape-retaining member 48. When shape-retaining member 48 is in the form of a raised edge, as previously described, the cover 62 will conform substantially to the raised edge.

In one embodiment of the present invention, pipette tip assembly 10 includes one longitudinally extending pipette tip 12, as described herein, abutment member 16 or 18 and a tip holder 32 which is interposable between abutment member 16 or 18 and upper plane 24 of tapered portion 28 of tip 12, as shown in FIG. 1A. The tip holder 32 has at least one holder aperture 34 for receiving tip 12. The holder aperture 34 has a taper 36 substantially corresponding to at least a portion of the tapered portion 28 of the tip 12.

Additionally, as previously described, the tip holder 32 of this embodiment is movable between an upper position 38 and a lower position 40. The holder aperture 34 is of sufficient diameter such that when the tip holder 32 is in the upper position 38, a lower portion of the abutment member 16 or 18 extends beyond the holder aperture 34. Preferably, the holder aperture 34 rigidly maintains the tip therein when the tip holder 32 is in the upper position 38 such that the tip holder 32 and the tip 12 form a substantially unified tip transport structure 42.

According to one aspect of the present invention, the holder aperture 34 may include a tip-securing member 70 adjacent to the taper 36 of the holder aperture 34, as depicted in FIG. 1B. Tip-securing member 70 is adapted to dig into tip 12 to ensure that tip 12 is held securely in holder aperture 34. FIG. 1B shows several embodiments of tip-securing member 70. Particularly, tip-securing member 70 may be a ring projecting inwardly from the taper 36 of the holder aperture 34. As shown in FIG. 1B, the ring may be positioned adjacent upper surface 50 of tip holder 32, intermediate upper surface 50 and under surface 53 of tip holder 32, or adjacent under surface 53 of tip holder 32. Other positionings of tip-securing member 70 relative to taper 36 are contemplated. Further, while tip-securing member 70 has been described as a ring, other shapes, including a barbed ring, are contemplated.

The present invention is additionally directed to a method for loading and unloading one or more of the pipette tips 12 into a pipette tip assembly 10. The method consists of providing at least one longitudinally extending pipette tip 12, a tip support 56 and a tip holder 32, as previously described, placing tip 12 in tip holder 32, applying sufficient pressure to tip 12 to rigidly maintain tip 12 in tip holder 32, positioning tip holder 32 and tip 12 maintained therein over tip support 56 such that the support aperture 60 receives the lower end 30 of tip 12, and moving tip holder 32 between the upper position 38 and the lower position 40.

According to one aspect of the present invention, the step of providing tip holder 32 preferably includes providing a tip holder 32 having a shape-retaining member 48 for retaining a shape of the tip holder 32 when pressure is applied to tip 12 placed therein. Preferably, the tip holder providing step further includes providing a tip holder 32 having at least one holder aperture 34 for receiving tip 12. Additionally, in a preferred embodiment, the step of applying sufficient pressure includes pressuring tip 12 into holder aperture 34, such that holder aperture 34 rigidly maintains tip 12 therein and tip holder 32 and tip 12 form a substantially unified tip transport structure 42.

As previously described, the pipette tip assembly 10 may include a plurality of stacked tip supports 56'. In such an embodiment, the tip support providing step includes providing at least one other tip support 56' with all of its attributes (such as including at least one other tip 12'), as previously described with respect to FIG. 2. According to one aspect of this inventive method, the tip support providing step further includes providing at least one other tip holder 32' with all of its attributes, as previously described with respect to FIG. 2. Additionally, the step of positioning tip holder 32 and tip 12 maintained therein includes positioning other tip holder 32' and other tip 12' maintained therein over tip support 56.

In the method of the present invention, the step of moving tip holder includes lifting tip holder 32 in a direction away from tip support 56 such that tip 12 is carried by tip holder 32 away from tip support 56. Similarly, in the stacked embodiment, the step of moving the tip holder includes lifting other tip holder 32' in a direction away from tip support 56 such that other tip 12' is carried by other tip holder 32' away from tip support 56.

In a preferred method, the step of moving the tip holder includes providing a cover 62, as previously described, placing the cover 62 over tip holder 32 such that the extended portion 64 of the cover 62 contacts tip holder 32, and applying sufficient pressure to the cover 62 in a direction towards tip holder 32 such that tip holder 32 is moved from the upper position 38 to the lower position 40.

The present invention is additionally directed to a method of holding one or more pipette tips, which comprises providing at least one longitudinally extending pipette tip 12, abutment member 16 or 18 and a tip holder 32 which is interposable between abutment member 16 or 18 and upper plane 24 of tapered portion 28 of tip 12, as previously described and shown in FIG. 1A. The providing step further includes providing tip holder 32 which has at least one holder aperture 34 for receiving tip 12, the holder aperture 34 having a taper substantially corresponding to at least a portion of the tapered portion 28 of tip 12, as previously described.

This method of the present invention further comprises placing tip 12 in tip holder 32 such that a lower portion of the abutment member 16 or 18 extends beyond tip holder 32, and applying sufficient pressure to tip 12 to rigidly maintain tip 12 in tip holder 32. As shown in FIG. 1B, according to one aspect of the present invention, the step of providing a tip holder includes providing a tip-securing member 70 adjacent to and projecting inwardly from the taper 36 of holder aperture 34.

As examples only, and not to limit the invention, dimensions of a particularly preferred embodiment will now be described. The lower surface 52 and under surface 53 of the tip holder 32 may have dimensions of approximately 4.750 inches by 2.335 inches. The upper surface 50 of the tip holder 32 preferably may have dimensions of approximately 4.380 inches by 3.010 inches. The lower surface 52 and the upper surface 50 of the tip holder 12 may be distanced by about 0.075 inches; thus, the shape-retaining member 48 of the tip holder 32, which is positioned between these two surfaces, preferably may be about 0.075 inches in height. Additionally, the under surface 53 and the upper surface 52 of the tip holder 32 may be distanced by about 0.125 inches.

In this preferred embodiment, adjacent holder apertures 34 are preferably spaced from one another by a distance of about 0.352 inches between the centers thereof. Preferably, the holder apertures 34 are tapered from an outer diameter of approximately 0.3284 inches at the upper surface 50 of the tip holder 32 to an outer diameter of approximately 0.3152 inches at the under surface 53 of the tip holder 32. Additionally, the holder apertures 34 are tapered from an inner diameter of approximately 0.1292 inches at the upper surface 50 of the tip holder 32 to an inner diameter of approximately 0.1226 inches at the under surface 53 of the tip holder 32, which corresponds to approximately a 3° taper in taper 36.

In an alternative embodiment of particularly preferred dimensions, the lower surface 52 and under surface 53 of the tip holder 32 has the above-described preferred dimensions, while the upper surface 50 of the tip holder 32 may have alternative dimensions of approximately 4.320 inches by 2.900 inches. In either the preferred or the alternative embodiment, a rib 20 of the ribbed abutment member 18 preferably has a thickness of 0.030 inches.

Preferred materials of construction for the pipette tip assembly 10 include polymeric thermoplastic materials. By way of example, and not to limit the invention, pipette tip 12, tip holder 32, tip support 56 and cover 62 may be composed of a pressure-resistant durable plastic, such as molded polypropylene. In a particularly preferred embodiment, pipette tip 12 is composed of polypropylene. The construction materials for pipette tip assembly 10 may be translucent or opaque and may be colored.

As described herein, the present invention provides a pipette tip assembly 10 in which pipette tips 12 can be maintained from undesired movement or wobble within pipette tip holder 32, so that pipette tips 12 can be easily transported, aligned with, loaded onto, or stacked onto tip support 56, and removed from tip support 56 for transport, repositioning, disposal or other purposes. Further, the present invention provides an assembly 10 in which the user can control the movement of pipette tip holder 32 between a tip-holding position 38 and a tip-releasing position 40. The present invention additionally provides a simple tip-releasing device in the form of multi-purpose cover 62 which further protects pipette tips 12 and assembly 10 from contamination. Further attributes and advantages of the pipette tip assembly 10 are readily apparent from this description.

As additionally described herein, the present invention provides a method of using the pipette tip assembly 10 in which one or more pipette tips 12 are pressed into pipette tip holder 32 and rigidly maintained therein, the pressed tips 12 and tip holder 32 are positioned relative to a tip support 56, and tip holder 32 is moved between tip-holding and tip-releasing positions 38 and 40 according to the user's particular requirement. Additionally, in the method of the present invention, multi-purpose cover 62 is provided as a simple tip-releasing device for moving the tip holder 32 from tip-holding position 38 to tip-releasing position 40. Additional attributes and advantages of the inventive method are readily apparent from this description.

It is to be understood that while the invention has been described above in conjunction with preferred specific embodiments, the description is intended to illustrate and not to limit the scope of the invention, which is defined by the scope of the appended claims.

It is claimed:

1. A pipette tip assembly, comprising:

at least one longitudinally extending pipette tip, the tip having an exterior surface defining a tapered portion, the tapered portion comprising a tapered abutment member which is inwardly tapered from an upper plane towards a lower plane and has a lower end disposed adjacent to the lower plane, wherein the upper and lower planes are transverse to a longitudinal axis of the tip when the tip is vertically oriented and wherein the lower plane is disposed above a lower end of the tip;

a tip support defining a support surface and having at least one support aperture therein, the support aperture adapted to receive the lower end of the tip with the lower end of the abutment member resting upon the support surface when the tip is vertically oriented; and, a tip holder, having at least one tapered holder aperture in which the tip is removably disposed, the tip holder disposed between the upper plane and the support surface, the tip holder selectively movable from an upper position relative to both the tip and the tip support, to a lower position in contact with the support surface, when in the upper position, the tip holder held above the support surface and rigidly maintaining the tip from wobble in the tip holder until selectively moved from the upper position, when in the lower position, the tip being removable from the tip holder.

2. The assembly of claim 1 in which the holder aperture has a taper substantially corresponding to at least a portion of the taper of the tapered portion of the tip.

3. The assembly of claim 1 in which the holder aperture is of sufficient diameter such that when the tip holder is in the upper position, the lower end of the abutment member extends beyond the holder aperture.

4. The assembly of claim 1 in which the holder aperture rigidly maintains the tip therein when the tip holder is in the upper position such that the tip holder and the tip form a substantially unified tip transport structure.

5. The assembly of claim 1 in which the holder aperture surrounds the tip when the tip holder is in the lower position such that the tip holder substantially stabilizes the tip from transverse movement with respect to the tip support.

6. The assembly of claim 1 in which the lower end of the abutment member has a bearing surface, an outer diameter of the abutment member at the bearing surface being greater than an inner diameter of the support aperture at a support surface of the tip support.

7. The assembly of claim 2 which the lower end of the abutment member has a bearing surface, an outer diameter of the abutment member at the bearing surface being greater than a diameter of the support aperture at a support surface of the tip support and less than an inner diameter of the holder aperture at a most tapered portion thereof.

8. The assembly of claim 7 in which the abutment member has a substantially smooth surface.

9. The assembly of claim 7 in which the abutment member includes a plurality of ribs.

10. The assembly of claim 9 in which the ribs are substantially evenly spaced and longitudinally oriented on the exterior surface of the tip.

11. The assembly of claim 1 in which the tip holder has a shape-retaining member for substantially retaining a shape thereof when the tip holder has the tip rigidly maintained therein.

12. The assembly of claim 11 in which the shape-retaining member includes a raised edge defining a shape-retaining structure between an upper surface and a lower surface of the tip holder and disposed adjacent to a perimeter of the tip holder.

13. The assembly of claim 1, further comprising a cover defining an extended portion and a recessed portion, the extended portion being formed to conform substantially to a shape of the tip holder along a perimeter thereof and the recessed portion being formed to provide a clearance between the tip and the cover when the cover is positioned over the tip holder.

14. The assembly of claim 13 in which the tip holder has a shape-retaining member for substantially retaining a shape thereof when the tip holder has the tip rigidly maintained therein and the extended portion of the cover is formed to conform substantially to a shape of the shape-retaining member.

15. The assembly of claim 12 in which the shape-retaining member includes a raised edge defining a shape-retaining structure between an upper surface and a lower surface of the tip holder and disposed adjacent to a perimeter of the tip holder and the extended portion of the cover is formed to conform substantially to a shape of the raised edge.

16. A pipette tip assembly, comprising:

at least one longitudinally extending pipette tip, the tip having an exterior surface defining a tapered portion, the tapered portion comprising a tapered abutment member which is inwardly tapered from an upper plane towards a lower plane and has a lower end disposed adjacent to the lower plane, wherein the upper and lower planes are transverse to a longitudinal axis of the tip when the tip is vertically oriented and wherein the lower plane is disposed above a lower end of the tip; and, a tip holder, having at least one tapered holder aperture in which the tip is removably disposed, the tip holder disposed between the upper plane and the lower end of the abutment member, the tip holder selectively movable from an upper position relative to the tip, to a lower position adjacent to the lower end of the abutment member, when in the upper position, the tip holder held above the lower end of the abutment member and rigidly maintaining the tip from wobble in the tip holder until selectively moved from the upper position, when in the lower position, the tip being removable from the tip holder.

17. The assembly of claim 16 in which the holder aperture is of sufficient diameter such that when the tip holder is in the upper position, the lower end of the abutment member extends beyond the holder aperture.

18. The assembly of claim 16 in which the holder aperture rigidly maintains the tip therein when the tip holder is in the upper position such that the tip holder and the tip form a substantially unified tip transport structure.

19. The assembly of claim 18 in which the holder aperture includes a tip-securing member adjacent to the taper thereof.

20. The assembly of claim 19 in which the tip-securing member is a ring which projects inwardly from the taper of the holder aperture.

21. A method for loading and unloading one or more pipette tips, comprising the steps of:

providing at least one longitudinally extending pipette tip, the tip having an exterior surface defining a tapered portion, the tapered portion being inwardly tapered from an upper plane towards a lower plane and comprising an abutment member which has a lower end disposed adjacent to the lower plane, wherein the upper and lower planes are transverse to a longitudinal axis of the tip when the tip is vertically oriented and wherein the lower plane is disposed above a lower end of the tip;

providing a tip support defining a support surface and having at least one support aperture therein, the support aperture adapted to receive the lower end of the tip with the lower end of the abutment member resting upon the support surface when the tip is vertically oriented;

providing a tip holder, having the tip removably disposed therein, the tip holder disposed between the upper plane and the support surface, the tip and the tip holder together of a construction sufficient to maintain the tip holder in an upper position relative to the tip and the tip support, the tip holder selectively movable from the upper position to a lower position in contact with the support surface, when in the upper position, the tip holder held above the support surface and rigidly maintaining the tip from wobble in the tip holder until selectively moved from the upper position, when in the lower position, the tip being removable from the tip holder;

placing the tip in the tip holder such that the lower end of the abutment member extends beyond the tip holder;

applying sufficient pressure to the tip to rigidly maintain the tip in the tip holder;

positioning the tip holder and the tip maintained therein over the tip support such that the support aperture receives the lower end of the tip; and, selectively moving the tip holder between the upper position and the lower position.

22. The method of claim 21 in which the tip holder providing step includes providing a tip holder having a shape-retaining member for substantially retaining a shape of the tip holder when pressure is applied to the tip placed therein.

23. The method of claim 21 in which the tip holder providing step includes providing a tip holder having at least one holder aperture for receiving the tip.

24. The method of claim 23 in which the step of applying sufficient pressure includes pressuring the tip into the holder aperture such that the holder aperture rigidly maintains the tip therein and the tip holder and the tip form a substantially unified tip transport structure.

25. The method of claim 21 in which the step of moving the tip holder includes lifting the tip holder in a direction away from the tip support such that the tip is carried by the tip holder away from the tip support.

26. The method of claim 21 in which the step of moving the tip holder includes:

providing a cover defining an extended portion and a recessed portion, the extended portion being formed to conform substantially to a shape of the tip holder and the recessed portion being formed to provide a clearance between the tip and the cover when the cover is positioned over the tip holder;

placing the cover over the tip holder such that the extended portion contacts the tip holder; and, applying sufficient pressure to the cover in a direction toward the tip holder such that the tip holder is moved from the upper position to the lower position.

27. A method of holding one or more pipette tips, comprising the steps of:

providing at least one longitudinally extending pipette tip, the tip having an exterior surface defining a tapered portion, the tapered portion being inwardly tapered from an upper plane towards a lower plane and comprising an abutment member which has a lower end disposed adjacent to the lower plane, wherein the upper and lower planes are transverse to a longitudinal axis of the tip when the tip is vertically oriented and wherein the lower plane is disposed above a lower end of the tip;

providing a tip holder, having the tip removably disposed therein, the tip holder disposed between the upper plane and the lower end of the abutment member, the tip and the tip holder together of a construction sufficient to maintain the tip holder in an upper position relative to the tip, the tip holder selectively movable from the upper position to a lower position adjacent to the lower end of the abutment member, when in the upper position, the tip holder held above the lower end of the abutment member and rigidly maintaining the tip from wobble in the tip holder until selectively moved from the upper position, when in the lower position, the tip being removable from the tip holder;

placing the tip in the tip holder such that the lower end of the abutment member extends beyond the tip holder; and, applying sufficient pressure to the tip to rigidly maintain the tip in the tip holder.

28. The method of claim 27 in which the step of providing a tip holder includes providing a tip-securing member adjacent to and projecting inwardly from the taper of the holder aperture.

29. The assembly of claim 16 in which the holder aperture has a taper substantially corresponding to at least a portion of the taper of the tapered portion of the tip.

30. The method of claim 23 in which the tip holder is provided with a holder aperture having a taper substantially corresponding to at least a portion of the taper of the tapered portion of the tip.

* * * * *

UNITED STATES PATENT AND TRADEMARK OFFICE

CERTIFICATE OF CORRECTION

PATENT NO. : 5,487,997

DATED : January 30, 1996

INVENTOR(S) : Philip E. Stolp

It is certified that error appears in the above-indentified patent and that said Letters Patent is hereby corrected as shown below:

In Column 10 at Line 7 in Claim 15 replace:

" 15. The assembly of claim 12 in which the shape-retaining"

with

-- 15. The assembly of claim 14 in which the shape-retaining--

Signed and Sealed this

Twenty-first Day of October 1997

*Attest:*

Bruce Lehman

BRUCE LEHMAN

*Attesting Officer*

*Commissioner of Patents and Trademarks*